US005522135A

United States Patent [19]

Votolato

[11] Patent Number: 5,522,135

[45] Date of Patent: Jun. 4, 1996

[54] BOX OPENER

[75] Inventor: Earl Votolato, Newport Beach, Calif.

[73] Assignee: Spellbound Development Group, Newport Beach, Calif.

[21] Appl. No.: 300,958

[22] Filed: Sep. 6, 1994

[51] Int. Cl.[6] ..... B26B 3/08

[52] U.S. Cl. ..... 30/2; 30/294; 30/317; 30/337

[58] Field of Search ..... 30/2, 286, 294, 30/314, 317, 337

[56] References Cited

U.S. PATENT DOCUMENTS

| | | | |
|---|---|---|---|
| 365,714 | 6/1887 | Warner . | |
| 2,376,887 | 5/1945 | Walters . | |
| 2,730,800 | 1/1956 | Bailey | 30/2 |
| 2,743,523 | 5/1956 | Honey . | |
| 3,430,339 | 3/1969 | Hobson . | |
| 3,781,988 | 1/1974 | Jones | 30/2 |
| 4,531,286 | 7/1985 | Vito et al. . | |
| 4,675,996 | 6/1987 | DuBuque | 30/2 |
| 5,234,436 | 8/1993 | Eaton et al. . | |
| 5,241,750 | 9/1993 | Chomiak . | |

*Primary Examiner*—Rinaldi I. Rada
*Assistant Examiner*—Jay A. Stelacone
*Attorney, Agent, or Firm*—William W. Haefliger

[57] ABSTRACT

A box opener comprising a blade having a cutting edge; a holder with blade, including a handle, and a terminal on the handle retaining the blade with the blade edge protruding; and a shield carried by the holder proximate the terminal, for movement between extended position in which the blade is protected, and retracted position in which the blade edge is exposed for cutting.

14 Claims, 6 Drawing Sheets

FIG. 9.
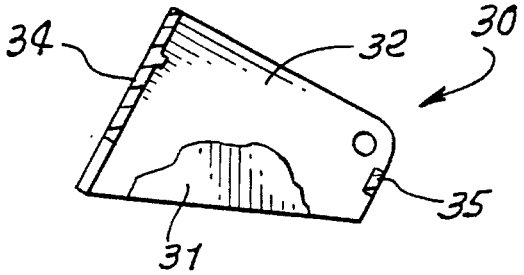
FIG. 10.
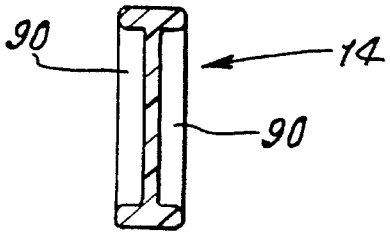
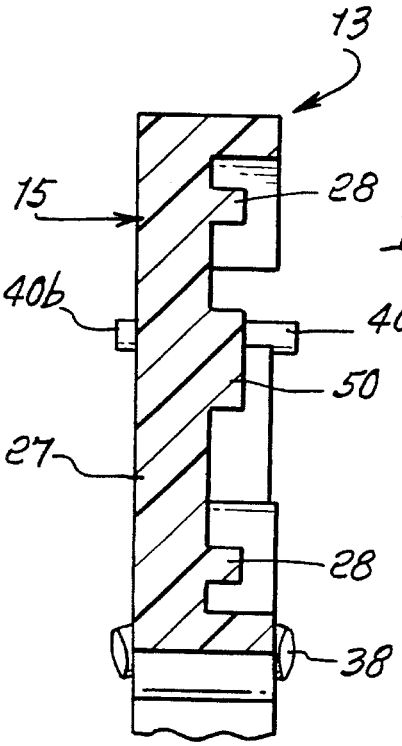
FIG. 11.
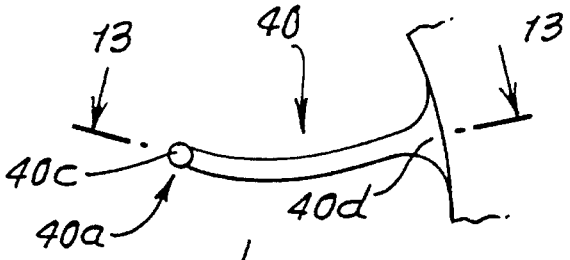
FIG. 12.
FIG. 13.
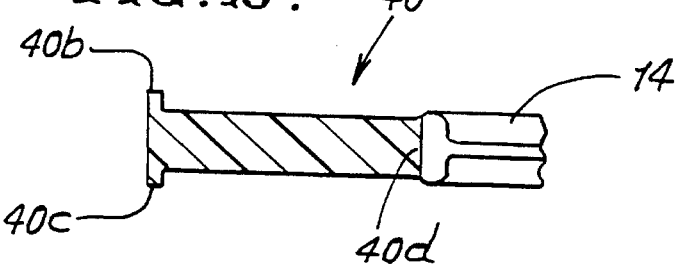

BOX OPENER

BACKGROUND OF THE INVENTION

This invention relates generally to slitting devices, as are used for opening boxes; and more particularly, to an improved device of simple, compact, lightweight construction and enabling its throw-away disposal.

There is need for devices, as referred to above, and in particular, there is need for very low cost such devices which are made to be thrown away without danger, which could otherwise be presented by slitting blade exposure.

SUMMARY OF THE INVENTION

It is a major object to provide an improved box opener in the form of a slitting device of simple, low cost, compact, throw-away construction, and which is safe to use, and safe when thrown away by virtue of blade protection. Basically, the device comprises:

a) a blade having a cutting edge, b) a holder for the blade, including a handle, and a terminal on the handle retaining the blade with the blade edge protruding, c) and a shield carried by the holder proximate the terminal, for movement between extended position in which the blade is protected, and retracted position in which the blade edge is exposed for cutting.

As will be seen, the shield typically includes a first section at one side of the blade, and a second section at the opposite side of the blade, the sections having lower edges that extend below the skewed blade cutting edge and an insert lower edge, in shield-extended position. The two sections are typically integrated to move together; and a web or webs may interconnect the two sections, with a pivot spaced from the web and pivotally connecting the sections to the holder to pivot between the shield retracted and extended positions.

It is another object to provide the device, as disclosed, and wherein the holder and shield consist of molded plastic material, whereby the holder, shield and blade are of throw-away construction.

A further object includes provision of a flat spring having one end thereof integral with the holder, and a pusher on the spring pushing the shield toward extended position, and via structure protected by the shield. A blade protector may be carried by the holder limiting shield movement toward extended position.

These and other objects and advantages of the invention, as well as the details of an illustrative embodiment, will be more fully understood from the following specification and drawings, in which:

DRAWING DESCRIPTION

FIG. 9 is an enlarged side view of the cut away shield, as also seen in FIG. 6;

FIG. 10 is an enlarged section as taken on lines 10—10 of FIG. 6;

FIG. 11 is an enlarged section taken on lines 11—11 of FIG. 5;

FIG. 12 is an enlarged side view of the pusher spring also seen in FIGS. 5 and 6;

FIG. 13 is a section taken on lines 13—13 of FIG. 12;

FIG. 22 is a left end view taken on lines 22—22 of FIG. 20;

DETAILED DESCRIPTION

Figure 1:
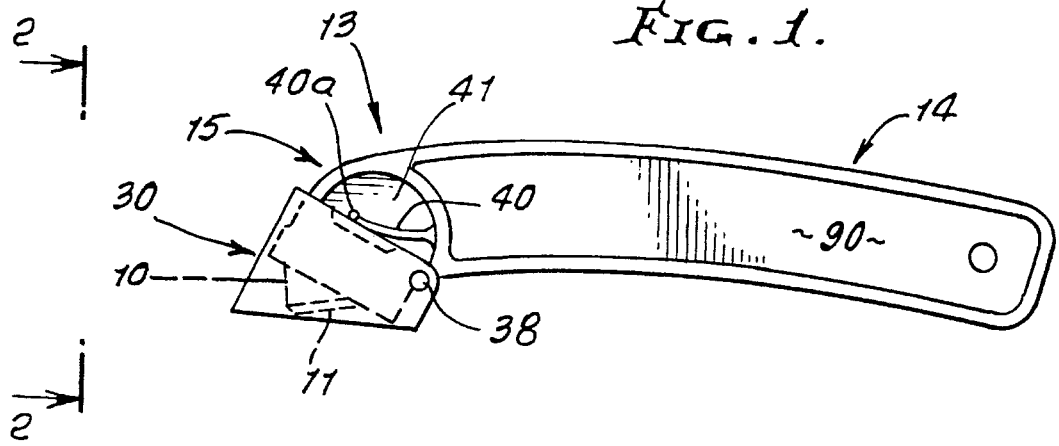
FIG. 1 is a left side view of the device of the invention, with blade shield shown in extended position.
Figure 2:
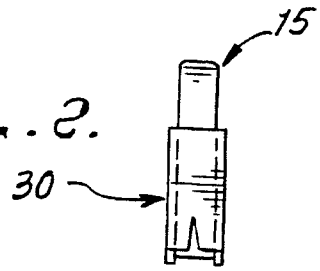
FIG. 2 is an end view taken on lines 2—2 of FIG. 1.
Figure 3:
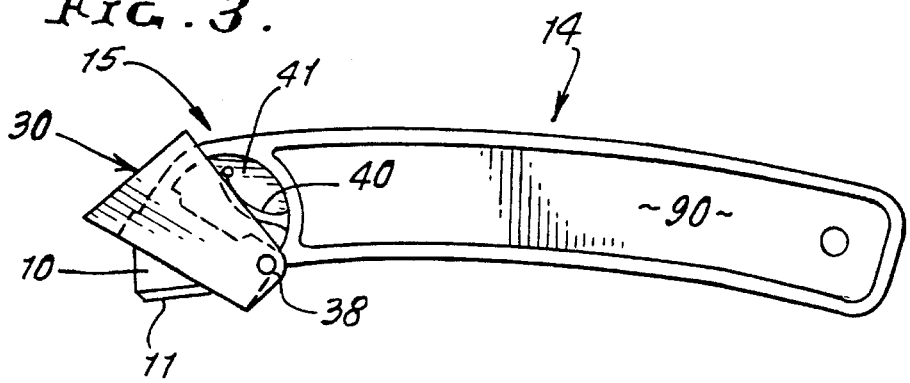
FIG. 3 is a view like FIG. 1 showing the shield in retracted position.

In the drawings, a thin, metallic, generally rectangular blade 10 has a lower, straight cutting edge 11, for slitting a panel 12. The latter may be provided by a pasteboard box, or other item needing slitting, as for opening.

A holder 13 for the blade includes an elongated handle 14, which may be curved, as shown and have side cutouts 90. The handle typically consists of low-cost molded plastic material, adapted for throw-away after the device is used. The handle has a curved terminal portion at which the blade is retained. Terminal portion 15 defines a first, shallow, flat, generally rectangular recess 16 to receive a flat, rectangular insert plate 17, which may consist of plastic material, and may be adhesively bonded to the plastic handle terminal portion. Recess 16 is bounded on three sides by linear shoulders 18, 19 and 20. Shoulder 20 is interrupted medially thereof to define a gap 21.

Figure 4:
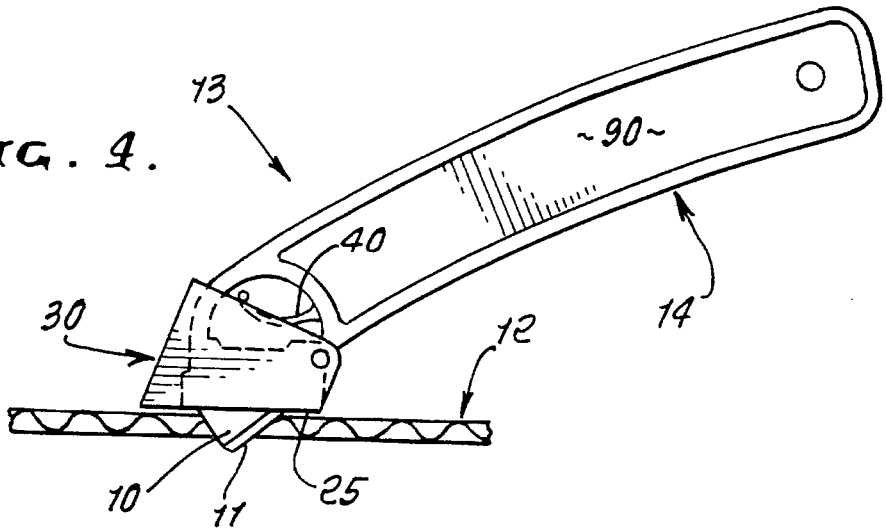
FIG. 4 is a view like FIG. 3 but showing the exposed blade slitting a box corrugated wall, and the shield lower edge flatly engaging the box upper wall.
Figure 5:
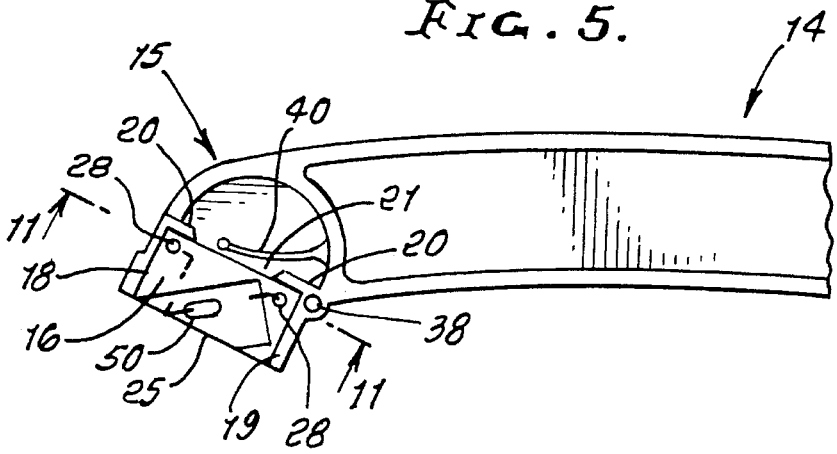
FIG. 5 is a view like FIG. 1 with shield removed.
Figure 6:
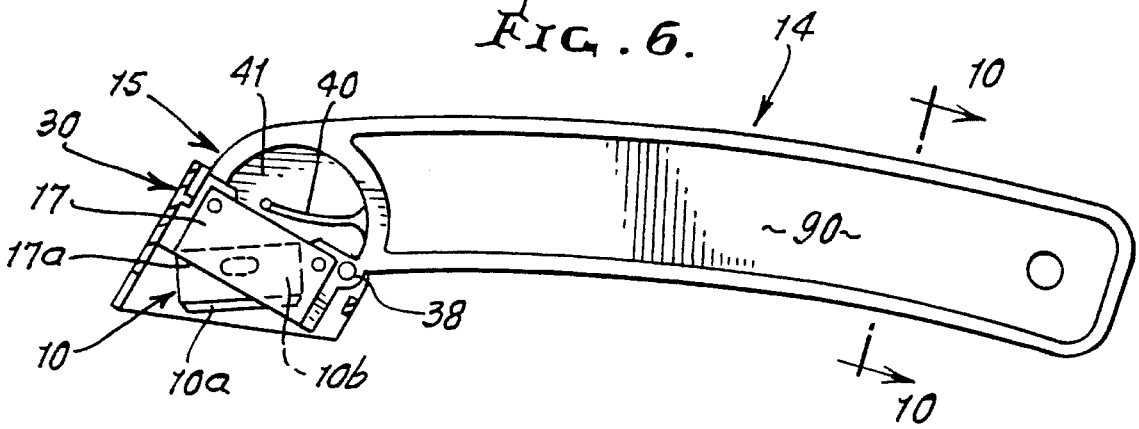
FIG. 6 is a view like FIG. 1 with shield partly cut away.
Figure 7:
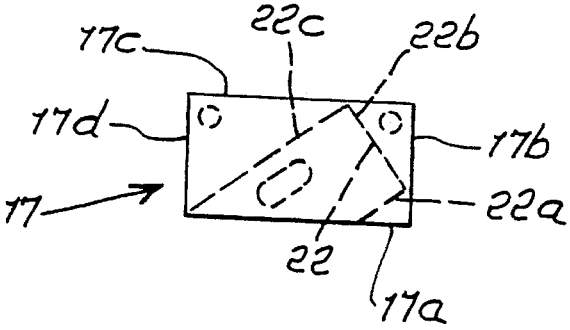
FIG. 7 is a side view of a blade protector, as also seen in FIG. 5.
Figure 8:
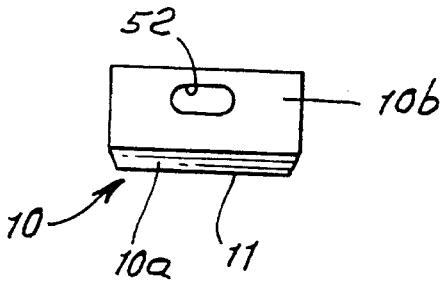
FIG. 8 is a side view of a blade, as also seen in FIG. 6.
Figure 15:
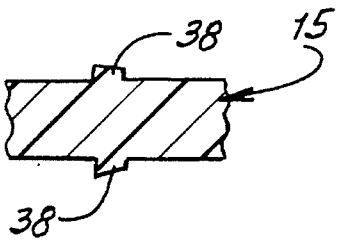
FIG. 15 is a section taken on lines 15—15 of FIG. 14.
Figure 14:
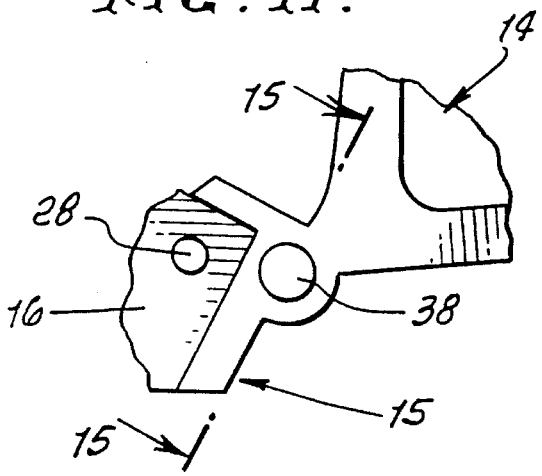
FIG. 14 is a fragmentary enlarged view of the holder showing a shield pivot.
Figure 16:
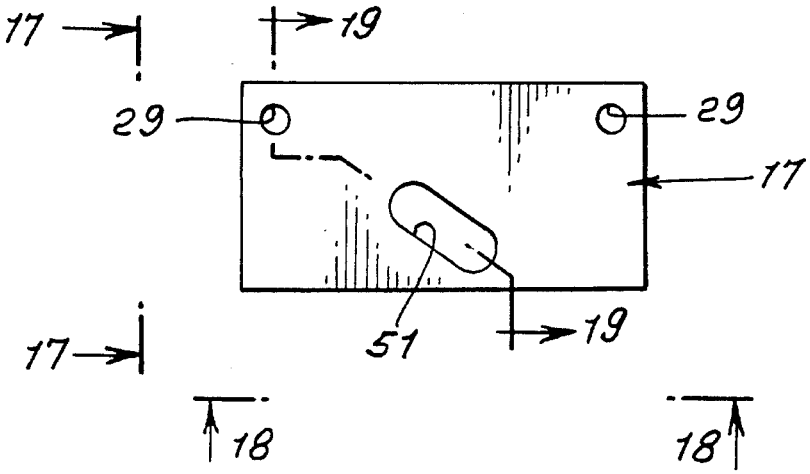
FIG. 16 is an enlarged side view of the blade protector.
Figure 17:
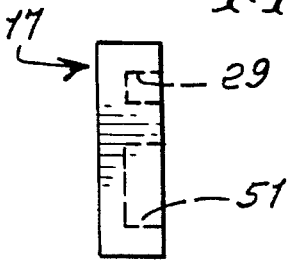
FIG. 17 is an end view taken on lines 17—17 of FIG. 16.
Figure 18:
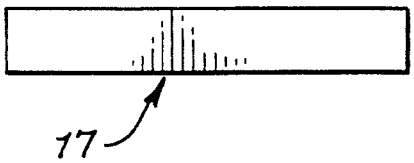
FIG. 18 is an edge view taken on lines 18—18 of FIG. 16.
Figure 19:
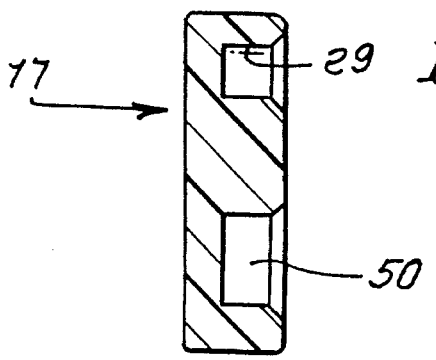
FIG. 19 is an enlarged section taken on lines 19—19 of FIG. 16.

The blade 10 is carried by the insert plate 17, with the blade cutting edge 10*a* projecting in skewed relation to a lower edge 17*a* defined by the plate 17. The plate 17 defines a flat, shallow, second recess 22 skewed relative to the outline of the plate, as seen in FIG. 7. See recess edges 22*a*, *b*, and *c* as related to plate edges 17*a*, *b* and *c*. The blade 10 is received in the second recess, to have a first portion 10*b* peripherally fitted therein or retained therein, with a second portion of the blade protruding edgewise from the second recess 22, as shown in FIG. 6. The blade-cutting edge 10*a* is then skewed relative to a lower edge 17*a* defined by the insert 17 adjacent the second recess lower edge 25. Edge 25 is adapted to ride on the surface of a pasteboard panel 12 (as on a box) being slit by the blade. See FIG. 4.

The blade first portion 10*b* is confined between a wall 17*e* defined by the insert 17, and a wall 27 defined by the handle terminal adjacent first recess 16, these walls extending in parallel relation. Insert 17 may be retained in the first recess 16, as by studs 28 molded on wall 27 and interferingly received in holes 29 in insert plate 17; i.e., insert 17 is adheringly connected to the handle terminal. The insert 17 has three edges 17*b, c* and *d* bounded by shoulders 18, 19 and 20. An elongated stud 50, integral with the holder projects into corresponding openings 51 and 52 in insert 17 and blade 10, to positively position them.

A shield 30 (of plastic molded construction) is carried by the holder proximate the terminal, for movement between extended position in which the blade is protected, and retracted position in which the blade edge is exposed for cutting. The shield includes a first wall section 31 at one side of the blade, and second wall section 32 at the opposite side of the blade, those sections extending parallel to the plane of the blade. The shield wall sections have lower edges 31*a* and 32*a* that extend below the skewed lower edge of the blade and the lower edge of the insert 17, in shield-extended position seen in FIG. 6.

Sections 31 and 32 are integral to move together, and for this purpose, webs 34 and 35 interconnect the sections at forward and rearward locations. See FIGS. 20–23. Pivot trunnions 38 are spaced from the webs, and pivotally connect the wall sections 31 and 32 to the holder 13, to allow shield pivoting between extended and retracted positions.

Figure 20:
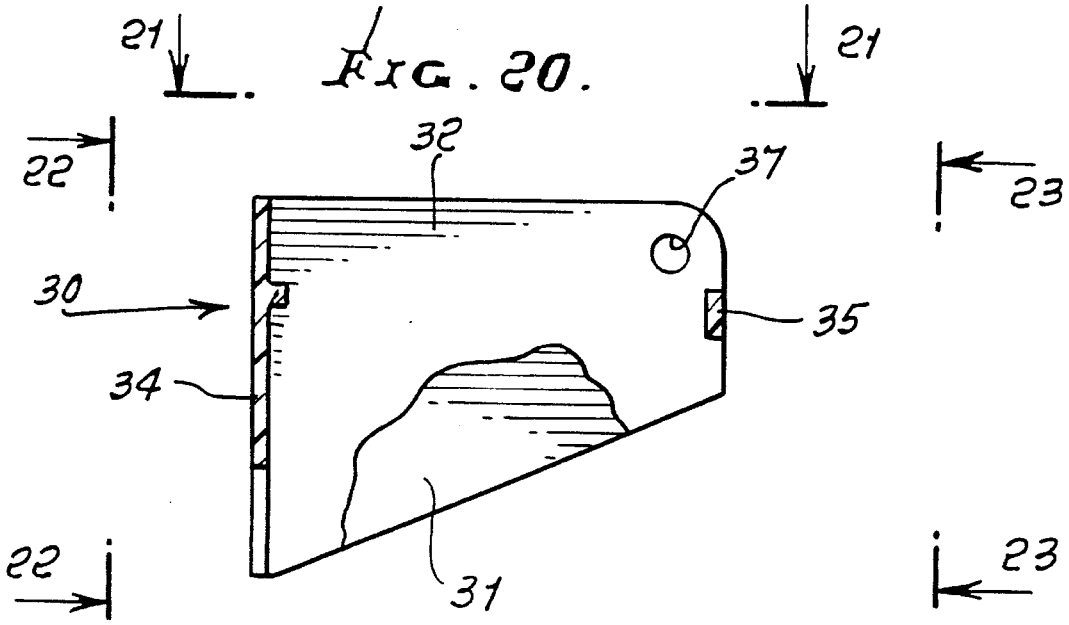
FIG. 20 is an enlarged side view of the blade shield.
Figure 21:
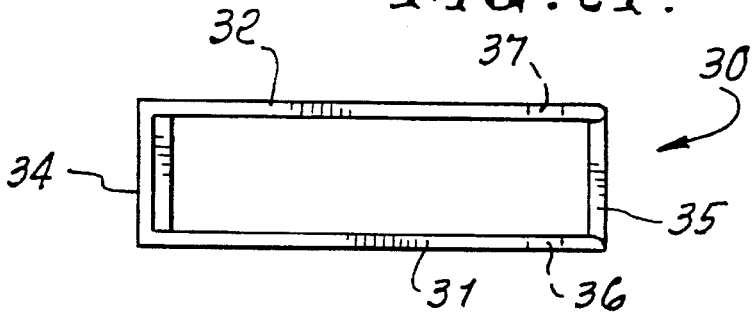
FIG. 21 is an edge view taken on lines 21—21 of FIG. 20.
Figure 24:
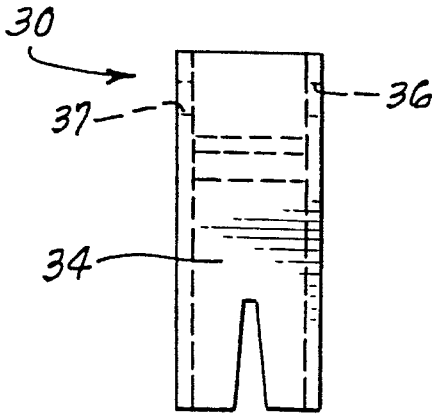
FIG. 24 is an enlarged fragmentary view taken on lines 24—24 of FIG. 23.
Figure 23:
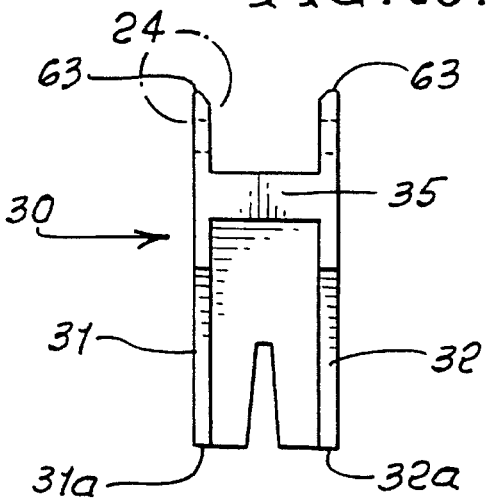
FIG. 23 is a right end view taken on lines 23—23 of FIG. 20.
Figure 24:
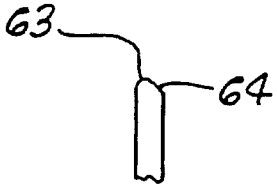
Figure 25:
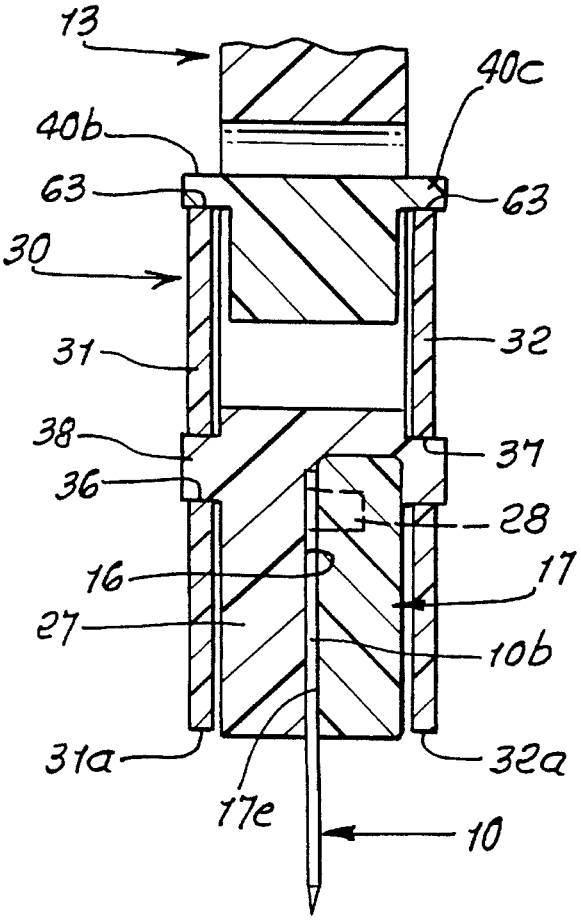
FIG. 25 is a section through an assembly of elements corresponding to those of FIGS. 1–24.

FIGS. 20 and 23 show holes 36 and 37 in the wall sections 31 and 32 to receive pivot pin trunnions 38 that may be integrally molded to the holder to project oppositely. See FIG. 11 and FIG. 25.

An elongated, transversely flat, cantilever spring 40 is carried by the handle to project in open space 41 in the plane of the handle, the spring having a free end 40*a* proximate the previously defined gap 21. As shown in FIGS. 12 and 13, the spring has shoulders 40*b* and 40*c* projecting laterally from the plane defined by the flat handle, to slidingly engage the top edges 63 of the shield wall sections 31 and 32, to resiliently and yieldably resist shield pivoting upwardly. The opposite end 40*d* of the cantilever spring is integral with the handle. The spring biases the shield to FIG. 1 position, protecting the blade when not in use. See also bevels 64 on edges 63. The spring may also consist of molded plastic material and be integral with 14 and 15.

The device of the invention is highly compact, made of molded plastic, is of low-cost construction, and is adapted for throw away after use. At the same time, the blade is firmly retained and is well protected by the shield, except during use to slit pasteboard, as referred to, whereby the device is very safe. Trunnions appear at 38, in FIG. 11.

I claim:

1. In a box opener, the combination comprising a) a blade having a cutting edge, b) a holder for the blade, including a handle, and a terminal on the handle retaining the blade with the blade edge protruding, c) and a shield carried by the holder proximate said terminal, for movement between extended position in which the blade is protected, and retracted position in which the blade edge is exposed for cutting, d) said terminal defining an opening, there being a cantilever spring carried by the holder and having a free end movable in said opening, e) the spring projecting in a plane defined by the handle terminal and having shoulders projecting laterally from said plane, the shield having blade protection sections extending parallel to said plane, at opposite sides thereof, the spring shoulders engaged by said sections as the shield is moved from extended to retracted positions.

2. The combination of claim 1 wherein the holder includes an insert plate carried by said terminal, the blade carried by the insert plate with the blade edge projecting in skewed relation to a lower edge defined by the plate.

3. The combination of claim 2 wherein the blade has one side and an opposite side, the shield including a first section at said one side of the blade, and a second section at said opposite side of the blade, said sections having lower edges that extend below the skewed blade cutting edge and insert lower edge, in shield-extended position.

4. The combination of claim 3 wherein said sections are integral to move together.

5. The combination of claim 4 including a web interconnecting said sections and a pivot spaced from said web and pivotally connecting the sections to the holder to pivot between said shield retracted and extended positions.

6. The combination of claim 3 wherein said terminal has flat, opposite sides in sliding engagement with said sections.

7. The combination of claim 6 wherein said terminal defines a first, flat, shallow recess, the insert plate received in the first recess, the insert plate defining a flat, shallow second recess, the blade having a first portion received in the second recess and a second portion protruding edgewise from that recess, with said cutting edge skewed relative to a lower edge defined by the second recess and insert plate.

8. The combination of claim 7 wherein said lower edge defined by the second recess and insert plate is adapted to ride on the panel being cut by said protruding second portion of the blade.

9. The combination of claim 7 wherein the handle and the insert plate consist of molded plastic material, the insert plate adheringly connected to said handle terminal.

10. The combination of claim 7 wherein the blade first portion is confined between a wall defined by said insert plate and a wall defined by said handle terminal portion.

11. The combination of claim 1 wherein said holder and shield consist of molded plastic material, whereby the holder, shield and blade are of throw-away construction.

12. The combination of claim 1 wherein said spring has one end thereof integral with the holder, the spring pushing the shield toward extended position, the blade protected by the shield.

13. In a box opener, the combination comprising a) a blade having a cutting edge, b) a holder for the blade, including a handle, and a terminal on the handle retaining the blade with the blade edge protruding, c) and a shield carried by the holder proximate said terminal, for movement between extended position in which the blade is protected, and retracted position in which the blade edge is exposed for cutting, d) the holder including an insert plate carried by said terminal, the blade carried by the insert plate with the blade edge projecting in skewed relation to a lower edge defined by the plate, e) the blade having one side and an opposite side, the shield including a first section at said one side of the blade, and a second section at said opposite side of the blade, said sections having lower edges that extend below the skewed blade cutting edge and insert lower edge, in shield-extended position, f) the terminal having flat, opposite sides in sliding engagement with said sections, the terminal defining a first, flat, shallow recess, the insert plate received in the first recess, the insert plate defining a flat, shallow second recess, the blade having a first portion received in the second recess and a second portion protruding edgewise from that recess, with said cutting edge skewed relative to a lower edge defined by the second recess and insert plate, g) said blade first portion being confined between a wall defined by said insert plate and a wall defined by said handle terminal portion, h) and wherein said terminal portion defines shoulders bounding the first recess at three sides thereof, one of said shoulders being interrupted medially thereof to define a gap, and there being a cantilever spring carried by the handle and having a free end proximate said gap, and adapted to be deflected by the shield as the shield moves from extended to retracted positions.

14. The combination of claim 13 wherein the spring projects in a plane defined by the handle terminal and has shoulders projecting laterally from said plane, the shield having blade protection sections extending parallel to said plane, at opposite sides of that plane, the spring shoulders engaged by said sections as the shield is moved from extended to retracted positions.

* * * * *